United States Patent [19]

Wustrow

[11] 4,217,949

[45] Aug. 19, 1980

[54] CORE FOR THE MAKING OF CASTINGS EQUIPPED WITH SLENDER DUCTS

[76] Inventor: Karl Wustrow, Konigsberger Str. 5, 3207 Borsum, Fed. Rep. of Germany

[21] Appl. No.: 788,368

[22] Filed: Apr. 18, 1977

[30] Foreign Application Priority Data

Sep. 28, 1976 [DE] Fed. Rep. of Germany ..... 2643525

[51] Int. Cl.[2] ..... B22C 9/10; B22C 9/24

[52] U.S. Cl. ..... 164/370; 164/400; 249/183; 249/184

[58] Field of Search ..... 164/366, 370, 400, 364, 164/368; 249/175, 183, 184; 425/DIG. 12, 176, 14

[56] References Cited

U.S. PATENT DOCUMENTS

| | | | |
|---|---|---|---|
| 1,994,155 | 3/1935 | Voight . | |
| 2,045,556 | 6/1936 | Almen | 249/175 X |
| 3,020,615 | 2/1962 | Peters | 249/175 X |
| 3,933,453 | 1/1976 | Burke et al. | 164/400 |

FOREIGN PATENT DOCUMENTS

| | | |
|---|---|---|
| 823644 | 12/1951 | Fed. Rep. of Germany . |
| 1289294 | 2/1969 | Fed. Rep. of Germany . |
| 2163694 | 7/1973 | Fed. Rep. of Germany . |

OTHER PUBLICATIONS

A. Diderat Pictorial Encyclopedia of Trades and Industry, Dover Publications, Inc., N.Y., vol. One, plate 108–114.

*Primary Examiner*—Robert D. Baldwin
*Assistant Examiner*—Gus T. Hampilos
*Attorney, Agent, or Firm*—Warren, Chickering & Grunewald

[57] ABSTRACT

In foundry manufacture of metallic castings it is customary to employ inserts to form elongate ducts whether rectilinear curved or branched ducts and whether of regular cross-section or varying cross-section, including enlarged cavities. A core insert is disclosed which has a wire formed outer tubular casing and an internal wire structure, the core insert being removable in stages. Removal is accomplished by first removing a central longitudinal wire, then any intermediate layer is removed and finally by uncoiling the outer tubular casing, which has preferably previously been wound in such manner and of such diameter wire as to avoid, so far as possible, any exaggerated surface undulations.

7 Claims, 9 Drawing Figures

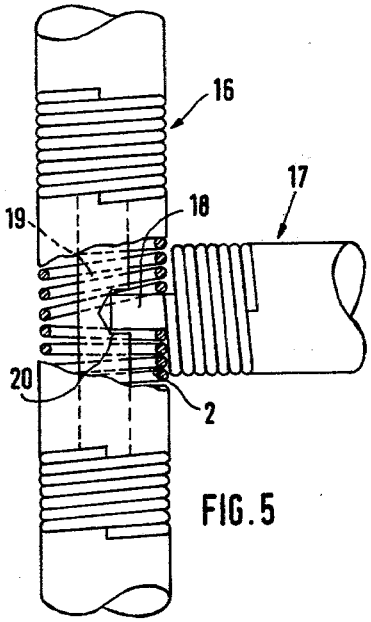
FIG. 5
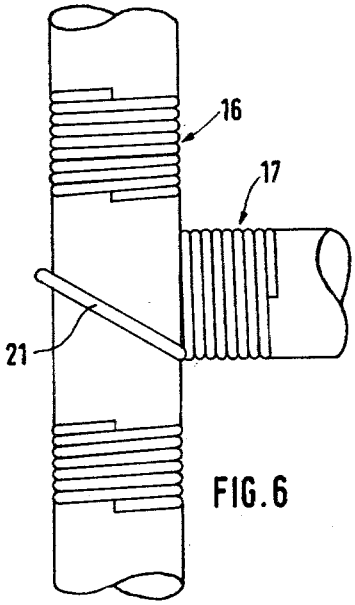
FIG. 6
FIG. 7
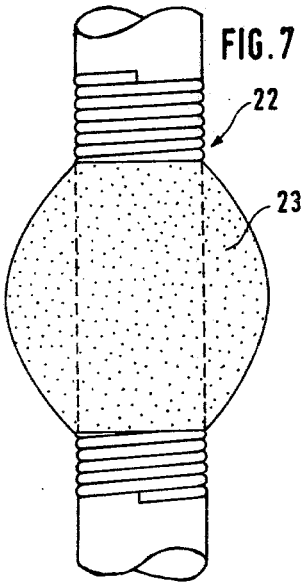
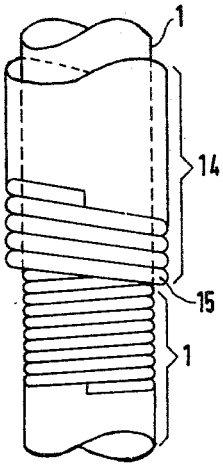
FIG. 4

CORE FOR THE MAKING OF CASTINGS EQUIPPED WITH SLENDER DUCTS

BACKGROUND OF THE INVENTION

This invention relates to a core for use in the manufacture of castings having ducts therein.

In foundry practice, when cavities are to be formed in a casting, cores are inserted into the casting mould. These cores are usually made of core sand bonded with a binding agent and are removed after the casting has been cast and cooled.

More recently, the problem has increasingly arisen of forming long, slender ducts, such as through ducts or possibly also intersecting or cut-off ducts, in the castings in order to integrate into the casting hydraulics or pneumatic lines, such as control lines, oil return lines and pressure lines.

Such elongate ducts cannot be made either sufficiently long or sufficiently slender with sand cores, because long, slender sand cores are much too likely to break both in manufacture and also during further processing, such as blacking and placing in the mould. Moreover, such cores are not sufficiently able to withstand the forces which occur during casting. Even when it is possible to introduce them undamaged into the mould, a relatively large wastage rate still always occurs. It is indeed possible to support such long, slender sand cores in the mould by means of core marks. However these core marks lead to undesired apertures in the casting, which must subsequently be closed again and which in any case constitute a defect. Moreover, sand cores require special measures for removing the gases produced during casting (in particular on account of the binding agent), since otherwise there is a risk or porosity being produced in the casting. The drawing off of the gases produced during casting usually takes place through further passages formed in the casting and leading upwards, which naturally give rise to additional, undesired holes.

The production of slender ducts, in particular those which are not straight, by means of sand cores is nevertheless still possible for diameters in the region of about 6 mm, although the aforementioned disadvantages must be accepted. It is however, simply no longer economic to make smaller diameters, of for example 5 mm and less, by means of sand cores. A way out of this difficulty hitherto used has been to drill out the ducts in the casting subsequently. This is complicated and expensive. Moreover it necessitates many additional auxiliary and cut-off bores when the ducts are curved, which again must subsequently be closed.

There is therefore a requirement for a core, which enables the production of long, slender ducts in a casting, without its use being adversely affected by a high susceptibility to breakage or high gas production. The task underlying the present invention therefore is to create such a core.

SUMMARY OF INVENTION

According to the present invention, there is provided a core comprising a tubular casing formed by helical turns of wire defining a surface surrounding an internal wire structure. Advantageously the internal structure consists of an axially extending central wire and a wire helix disposed around this and formed of a plurality of individual wires.

The invention enables a casting with ducts to be formed without the use of "core sand". Instead of this sand, the core of the preferred embodiments comprises a number of wires in such an arrangement as to result in a kind of flexible tube, which can be brought permanently into any desired pattern of curvature. In particular embodiments, it is also possible for branches, stepped-down diameters or larger cavities of any desired geometrical shape to be formed within a duct.

This core is not susceptible to fracture in the manner of a sand core nore does this core require special measures for degassing since the core contains practically no gasgenerating substances. Before insertion the wire may be coated with a thin coating of founder's black, which the founder always applies to all cores as an agent to prevent binding with the casting. This may cause minimal gassing. The core has in the preferred embodiments, an internal structure sufficiently permeable to enable venting and degassing if required along the length of the core to one or both the ends. Consequently the passages in the casting, which hitherto have been necessary for core marks and for venting, are now only necessary in very exceptional cases. It is now possible using the core of a preferred embodiment to form ducts having a diameter of 2 mm or even less.

The removal of the preferred core from the finished casting presents no problems. Firstly wires of the internal structure are withdrawn, and then the outer wire helix can be pulled turn by turn out of the duct. This enables removal without sliding occuring between the external wire helix and the wall of the duct formed in the casting. In addition, investigations have shown that there is practically no risk of wire breakages.

The preferred embodiment of the core does not have any negative influences upon the casting. Investigations have shown that the structure of the casting even in the region of the duct is completely undisturbed and that the duct possesses a satisfactory smooth cast surface.

BRIEF DESCRIPTION OF THE DRAWINGS

Embodiment of the invention will now be described, by way of example only, with reference to the accompanying drawings, in which:

FIG. 4 is a side elevational view of a modification of the core of the present invention for forming stepped-down duct diameters.

FIGS. 5 and 6 are side elevational views of two modifications for cores with branched ducts; and, FIG. 7 is a side elevational view of a a core for forming a duct with a larger cavity therein.

DETAILED DESCRIPTION OF EMBODIMENTS

Figure 1A:
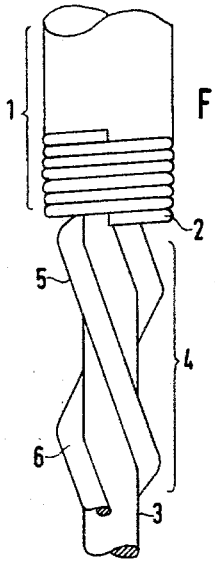
FIG. 1*a* is a side elevational view of a core constructed in accordance with the present invention.

In each of the embodiments shown diagrammatically in FIGS. 1 *a,b*, and 2 *a,b* the core is constituted of three parts, namely (from the inside outwards) of a central wire 3, an intermediate wire helix or layer 4 and of an outer wire helix or tubular casing 1. The outer wire helix or casing 1 is constituted of a single wire 2, which is so closely wound that the individual turns are in contact with one another to form a tubular casting defining surface. The cross section of this wire 2 may be either circular or polygonal. A preferred material for wire 2 is tension spring steel, which material ensures in a particularly satisfactory manner that the individual turns of the wire helix 1 lie close against one another. The central wire 3 and intermediate wire helix or layer 4, which together constitute the internal structure of the core, are, for example of copper, soft iron or a suitable plastically flexible material possessing adequate tensile strength and low susceptibility to damage under casting conditions. In all cases, the external wire helix or casing 1 defines the effective core diameter and also constitutes a tubular casing for the internal structure.

Figure 1B:
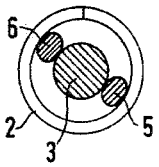
FIG. 1*b* is an end elevational view of the core of FIG. 1*a*.
Figure 2A:
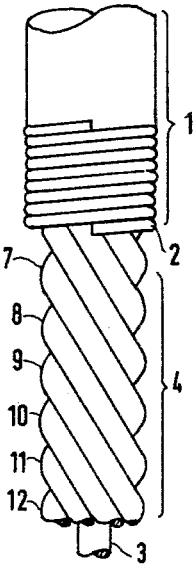
FIG. 2*a* is a side elevational view of an alternative embodiment of the core of FIG. 1*a*.
Figure 2B:
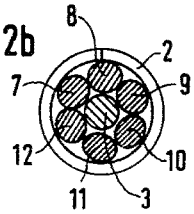
FIG. 2*b* is an end elevational view of the core of FIG. 2*a*.

The intermediate wire helix or layer 4 advantageously may be constituted by a plurality of helically wound wires, the turns of which may be in contact as with the six wires 7 to 12 in FIGS. 2*a* and 2*b* but which may be spaced circumferentially from one another in the manner of the two wires 5 and 6 in FIGS. 1*a* and 1*b*. The central wire 3 extends longitudinally, that is straight along the core axis. The intermediate wire helix or layer 4 maintains, in the manner of a spacer, the axial position of the central wire 3 relative to the external wire helix or casing 1. When the duct to be formed is straight or only slightly curved, it is also possible for the intermediate wire helix 4 to be completely dispensed with, so that the internal structure consists only of the central wire 3.

To make a core of this type, the internal structure is first formed. For this purpose, the wires of the intermediate wire helix 4 are wound in light contact onto the central wire 3, the turns for only two wires 5, 6 (FIGS. 1*a* and 1*b*) being of double pitch and in the case of more than two wires, accordingly of multiple pitch (that is with a sixfold pitch in the example of FIGS. 2*a* and 2*b*). After the internal structure has been prepared, a prefabricated steel helix is pushed onto this as the outer wire helix or casing 1, it being necessary for the diameters to be so selected that this push-fitting can be easily carried out. In one numerical example with a core of 5 mm diameter, a wire of 2 mm diameter can be used for the central wire 3 and two wires each of 0.9 mm diameter as the wire helix 4 (according to FIG. 1), while for the wire helix 1, a helix having a mean helix diameter of 4.5 mm of spring steel wire of 0.5 mm diameter can be used.

When the core is to be used for making a duct in the casting which is not straight, but has some kind of curve, the core must be accordingly bent. This may be achieved using a template and bending device, but it is also possible to fit the core by hand into an appropriate core box. Apart from this, the core must be so bent that possible sagging of the core in the mould and/or any changes to the core during casting (for example due to buoyancy or thermal expansion) are compensated.

Before being inserted into the mould, the core 1 must be blackened, that is furnished with a parting coating in the conventional way. For this purpose ordinary founder's blacks may be used, for example those having a talcum basis for light metal alloys or having a graphite zirconium basis for iron-carbon alloys. The black can be applied by brushing, spraying or dipping. It is however important to ensure that, in any case, blacking is not carried out until after all bending and finishing processes have been completed, since otherwise the black can chip off locally during bending. In addition, care must be taken to ensure that the core is provided by the blacking operation with a uniformly closed surface and that in particular the gaps which inevitably appear at the outer edge at sharp bends between individual turns of the external wire helix 1 are well smeared, since otherwise the liquid casting metal can penetrate into these cavities.

Figure 3:
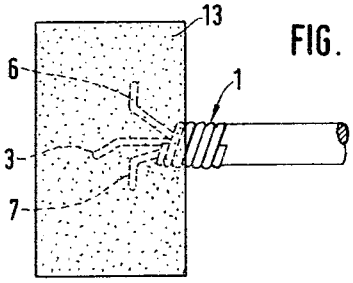
FIG. 3 is a side elevational view of a core end mounted to a core mark.

The fixing of the core in the mould does not present any special difficulty. Where the position of the core in the mould is symmetrical, the core is simply attached at its ends in the parting plane of the mould. Where the position of the core is asymmetrical, conventional core marks 13 of core sand (FIG. 3) can be fitted to the ends of the core. In this connection, it is of advantage to fray out the ends of the core somewhat in the manner shown in FIG. 3, in order to obtain a good bond of the core ends and the core marks. However, if the mould space permits the core end may also be used directly for supporting the core even when it is asymmetrically positioned by bending over the core ends in such a way that they constitute an abutment in the mould.

It is a particular advantage that the core is resistant to fracture and inherently stable in shape. As a result, it is possible to limit to a minimum or often completely omit the supports for the core which would otherwise be required to prevent breakage and bending, which are frequently necessary and in general a cause of trouble. This means that undesired holes in the casting, caused by core marks, which must later be closed by additional plugs, now occur only in exceptional cases. Also, no special measures are normally necessary for venting the core and in particular no vent passages need to be provided in the casting so that there are also no undesired passages in the casting for venting purposes. In any event, the core may contain gas-generating binding agents only in the region of the founder's black coating, which have no noticeable effect, and in addition the internal structure of the core is sufficiently "open" for the air in the core in all cases to escape outwards along the internal structure of the core.

When the casting has been cast and removed from the mould, the core initially remains in the casting and must then be pulled out in a further operation. This also is a simple operation, presenting no problems. After the core end projecting out of the casting has been frayed out, the central wire 3 is first pulled out of the duct formed in the casting by the core, followed by the individual wires of the intermediate wire helix 4. Following this, pulling out of the external wire helix 1 takes place. This pulling movement causes the helix 4 to stretch into an elongated wire so that turn by turn its contact is lost with the surface of the casting in the region of the duct formed by the core. As a result of the prior pulling out of the individual wires of the internal structure of the core, there is sufficient room for this loosening of the external wire helix 1, so that when the external wire helix 1 is pulled, it does not need to execute any sliding movement relative to the surface of casting in the duct. Therefore, even drastically curved cores can be pulled out of the casting with no more difficulty than substantially rectilinear cores.

In individual cases, it may be of advantage, especially for highly curved cores to blow a few drops of oil by compressed air through the turns of the internal structure from the inlet end of the core, before it is pulled out in order to prevent the separate wires of the internal structure from jamming one against another at the bends, thus facilitating pulling out of the wires.

These embodiments are not limited to core construction for forming individual ducts of constant diameter. Embodiments are provided for use in the production of ducts of stepped diameter and also for producing ducts possessing single or multiple branches. These embodiments are explained below with reference to FIGS. 4 to 7.

FIG. 4 illustrates one embodiment of a core for forming ducts with a stepped diameter. This core construction starts from an existing core of the embodiment above, according to FIGS. 1*a* and 1*b* or 2*a* and 2*b*. Over a portion of core, however, a further wire helix 14 is pushed, which like the wire helix 1 consists of a single, closely wound wire 15 (for example again of tension spring steel). This further wire helix 14 defines, by its external diameter, a widened diameter of the duct to be formed in the casting. This helix 14 is so disposed upon the existing core 1 that the one end of the wire helix 14 is situated in the casting at the position at which a stepped-down diameter is to be produced in the duct. Thus, the wire helix 14 projects to and through only one end and not, like the wire helix 1, through both ends of the duct to be formed in the casting.

The bending, preparation and coating of the core in the embodiment according to FIG. 4 takes place in the manner already described. It is only necessary to give special attention to a thorough smearing of the transition between the wire helix 14 and the wire helix 1 with blacking. The pulling of the core out of the finished casting is also carried out in the manner already described, by first pulling out the existing core comprising the wire helix 1 and then the additional wire helix 14.

The metal helix diameter of the additional wire helix 14 and the thickness of the wire 15 must be so adapted that on the one hand the desired increase in diameter of the duct to be produced is ensured and on the other hand the additional wire helix 14 can be easily pushed over the wire helix 1. Where the changes in diameter are fairly large, however, this may render necessary a relatively large thickness for the wire 15, with the consequence that the additional wire helix 14 has a comparatively coarsely corrugated surface structure. In order to avoid this, in the case of fairly large sudden changes in diameter, it is possible, instead of one wire helix 14 of one wire of large thickness, to use two wire helices pushed one onto the other. In this case at least the externally situated wire helix may be of a wire of smaller diameter so that it possesses a correspondingly less undulating surface. This alternative is however, not illustrated in the drawings.

In addition, the production of a different core diameter also does not necessarily need to be achieved by the pushing on of one or more additional wire helices onto an existing core. Instead, it is possible for an external wire helix 1 of a relatively thin wire 2 to be pushed onto the internal structure of the core, in the form of embodiment of FIGS. 1*a* and 1*b* or 2*a* and 2*b* as far as the position of the desired increase in diameter. Then, from this position of increased diameter onwards, for an external wire helix 1 of a correspondingly thicker wire 2 to be used. Since however the aforementioned problem of an undulating surface can arise with the thicker wire 2, the method of which one or more further wire helices are pushed onto an existing core is preferable.

In order to produce branched ducts in a casting, it is necessary for a number of cores of the described type to be used and to be connected together at the branch point. This connection can be constructed in any desired manner provided only that it is sufficiently firm and does not impede the subsequent pulling out of the cores. An example of one particularly simple connection of the cores at the branch position is shown in FIG. 5.

FIG. 5 shows (partially in section and with the intermediate wire helix 4 omitted for simplicity from the drawing) a continuous core 16, from which a further branch piece 17 departs as a branch. The core 16 and branch piece 17 can be constructed according to FIGS. 1, 2 or 4 and do not need to have equal diameters. For the purpose of connecting the branch piece 17 to the core 16, the central wire 18 of the branch piece 17 is continued beyond the end of that branch piece and is inserted into a bore 20 in the central wire 19 of the continuous core 16. The bore 20 extends, according to the particular circumstances of the diameters, to about the centre of the central wire 19 or may be cut right through the central wire 19. In the vicinity of this bore 20 the turns of the external wire helix 1 are forced apart, as shown in FIG. 5, sufficiently far for the wire 2 not to be cut during the forming of the bore 20 and insertion of the central wire 18. The same applies also to the wires of the intermediate wire helix 4. The connection point between the continuous core 16 and the branch piece 17 must of course be thoroughly smeared with blacking.

If the central wire 19 is cut through, the core 16 and branch piece 17 can be pulled out in any desired sequence. If the central wire 19 is not cut through, the branch piece 17 is first pulled out, whereupon the pulling out of the continuous core 16 takes place. The weakening of the central wire 19 of the continuous core 16 caused by the bore 20 at the branch point does not normally constitute any problems.

Another simple possibility of connecting together the branch piece 17 and continuous core 16, which is shown in FIG. 6, consists in extending in external wire helix of the branch piece 17 somewhat beyond the end of that core piece and then of winding the free wire section 21 thereby formed at the end of the branch piece 17 externally around the continuous core 16. By comparison with FIG. 5, this method has the advantage that the continuous core 16 does not need to be weakened, but on the other hand, because of the lack of firm connection, it is also more difficult to prevent the end of the branch piece 17 from slipping along the continuous core 16, especially under the influence of the forces which occur during casting. The wire section 21 must therefore be very firmly tightened or otherwise secured on the continuous core 16, for example by anchoring its end between turns of the external wire helix of the core 16. The pulling out of the cores in the embodiment according to FIG. 6 is, moreover with advantage carried out in such a way that initially the continuous core 16 is pulled, followed by the branch piece 17.

FIGS. 5 and 6 illustrate examples of simple rectangular branches. It is also possible, in the same way, for oblique or multiple branches to be produced.

At times it is necessary to widen out the duct inside the casting to form a larger cavity, for example to obtain the best flow conditions or to constitute a collection or header chamber, from which further branches depart or in which instruments can be disposed. Widened regions of this type can also be formed without trouble as shown in FIG. 7, by providing at the desired position on the core 22, which has been formed in the above-described manner, a core widening or thickening 23 of the desired dimensions made of core sand. With advantage thickening 23 can be made, like the core marks referred to earlier, in the core box. After the core 22 has been pulled out, the core thickening 23 remains initially in the casting and it is then scraped, jetter or otherwise removed from the casting.

The core 22 does not by any means need to be a continuous core, but can if desired, be composed of two separate core-pieces, which may if necessary be of differing diameters. It is also of course possible for further branch pieces to extend from the thickening 23 in almost any desired direction, so that complicated branches can be produced in the casting, for example those in which one duct of fairly large diameter is continued in a star-shaped pattern into two or more ducts of smaller diameters. If instruments are to be disposed in the cavity formed in the casting by the core thickening, then the cavity can, if necessary, also be bored subsequently from outside in order to introduce and fix these instruments in position. All these possibilities are however, not further illustrated in the drawing.

The core according to this invention has been developed predominantly for light metal alloys as the casting material, but can be utilised for practically all casting materials (including plastics materials), the most suitable core coating or parting agents being used for each particular case. Particular casting methods envisaged include sand casting, chill casting and pressure casting. It is also, however quite possible for it to be used in plastics components made by injection moulding.

What is claimed is:

1. A high strength, collapsible core for the production of small diameter elongated ducts in metal castings including an outer tubular casing formed by side-by-side coils of a metallic wire, said wire being formed from a relatively hard and resilient metal; and an internal support structure mounted inside said tubular casing and formed for support of said tubular casing under molding pressures, said support structure being further formed for removal thereof from within said tubular casing after casting of said core into said metal casting and prior to removal of said tublar casing from said metal casting, wherein the improvement comprises:

said internal support structure is formed as an axially extending central wire and an intermediate helically wound wire layer having a plurality of separate wires surrounding said central wire.

2. A core as defined in claim 1 wherein, said tubular casing is formed of spring steel, and said internal support structure is formed from a metal wire selected from the group consisting of copper and soft iron.

3. A core as defined in claim 1, and at least one further wire helix mounted on and surrounding said tubular casing, and wherein said tubular casing is formed from a single wire.

4. A core as defined in claim 1, and a branch section of said core formed as defined for the remainder of said core and attached to said tubular casing for use in forming a casting with a branched duct.

5. A core as defined in claim 1, and a branch section of said core formed as defined for the remainder of said core and attached to said tubular casing for use in forming a casting with a branched duct, said branch section is anchored to said tubular casing by a wire loop formed from the wire of the tubular casing of said branch section.

6. A core as defined in claim 1, and core sand molded around said tubular casing for use in forming a cavity in a casting along the length of the duct formed by said core.

7. A core as defined in claim 1 wherein, said central wire is formed with a larger diameter than each of said wires of said intermediate helically wound wire layer.

* * * * *

UNITED STATES PATENT AND TRADEMARK OFFICE

CERTIFICATE OF CORRECTION

PATENT NO. : 4,217,949
DATED : August 19, 1980
INVENTOR(S) : Karl Wustrow

It is certified that error appears in the above-identified patent and that said Letters Patent are hereby corrected as shown below:

Column 1, line 36, after "risk", delete "or" and insert ---of---;

Column 3, line 2, after "tubular", delete "casting" and ---insert ---casing---;

Column 5, line 12, after "of" and before "core" insert ---this---;

Column 5, line 63, after "method" and before "which", delete "of" and insert ---by---;

Column 6, line 37, after "extending" and before "external", delete "in" and insert ---the---;

Column 5, line 33, after "The" and before "helix" delete "metal" and insert ---mean---; and Column 7, line 4, delete "jetter" and insert ---jetted---.

Signed and Sealed this

*Thirtieth* Day of *December 1980*

[SEAL]

*Attest:*

SIDNEY A. DIAMOND

*Attesting Officer*

*Commissioner of Patents and Trademarks*